US005097802A

United States Patent [19]

Clawson

[11] Patent Number: 5,097,802

[45] Date of Patent: Mar. 24, 1992

[54] CONDENSING FURNACE WITH SUBMERGED COMBUSTION

[75] Inventor: Lawrence G. Clawson, Dover, Mass.

[73] Assignee: Raytheon Company, Lexington, Mass.

[21] Appl. No.: 621,141

[22] Filed: Nov. 30, 1990

[51] Int. Cl.[5] ..... F22B 1/02

[52] U.S. Cl. ..... 122/31.1; 126/360 A; 126/101

[58] Field of Search ..... 126/360 R, 360 A, 101, 126/110 R, 116 R; 122/31.1

[56] References Cited

U.S. PATENT DOCUMENTS

| | | | |
|---|---|---|---|
| 2,214,912 | 9/1940 | Valjean | 431/31 |
| 3,003,546 | 10/1961 | Beach et al. | 431/265 |
| 3,857,670 | 12/1974 | Karlovetz et al. | 431/329 |
| 4,069,807 | 1/1978 | Hartig | 126/110 R |
| 4,488,537 | 12/1984 | Laurent | 431/31 |
| 4,603,681 | 8/1986 | Clawson . | |
| 4,653,466 | 3/1987 | DeHaan et al. . | |
| 4,681,085 | 7/1987 | Clawson . | |
| 4,726,353 | 2/1988 | Clawson . | |

*Primary Examiner*—Carroll B. Dority

*Attorney, Agent, or Firm*—William R. Clark; Richard M. Sharkansky

[57] ABSTRACT

A high efficiency furnace having a substantially continuous wet heat exchanger wherein such continuous wet operation is provided by raising the dew point of the combustion products by submerged combustion before introduction into said head exchanger. That is, a water holding reservoir is provided between the burner and the heat exchanger, and condensate flows from the heat exchanger back into the reservoir. The combustion products are drawn through the water in the reservoir by providing a partition having a submerged lower portion, and providing a pressure differential between the chambers on the two sides of the partition. The submerged passageway from one chamber to the other may preferably be a serrated bottom edge on the partition or a plurality of apertures in the partition. The pressure differential may be provided by using a combustion blower or alternatively, using an induced draft blower preferably disposed at the flue end of the heat exchanger. Also provided is a controller that continues to activate the blower for a predetermined time period after the fuel is shut off to the burner so that the heat exchanger is flushed with pure water condensate at the end of a burning cycle.

25 Claims, 4 Drawing Sheets

CONDENSING FURNACE WITH SUBMERGED COMBUSTION

BACKGROUND OF THE INVENTION

The field of the invention generally relates to recuperative or condensing furnaces, and more particularly relates to apparatus and method for elevating the dew point of combustion products before entry into a condensing heat exchanger.

As is well known, nonrecuperative furnaces transfer only sensible heat from the combustion products. That is, condensation does not occur within the primary heat exchanger because the combustion products are exhausted at a temperature above their dew point. Accordingly, heat transfer by nonrecuperative or noncondensing furnaces is commonly referred to as a dry process.

In contrast, recuperative furnaces not only transfer sensible heat, but also cool the combustion products below their dew point so that heat of condensation is also transferred to the exchange medium. The additional transfer of heat by a recuperative heat exchanger has the advantage of increasing the overall furnace efficiency such as, for example, to approximately 95% whereas nonrecuperative furnaces are generally limited to less than 90%. Besides providing high efficiencies, the lower exhaust temperatures of recuperative furnaces enable the use of inexpensive exhaust venting such as, for example, PVC pipe rather than conventional chimneys.

Recuperative furnaces, however, are subject to corrosive attack of the recuperative heat exchanger by acidic condensate forming therein. In combusting natural gas, and to a greater extent fuel oil, a number of potentially acidic forming gases are produced. Although these gases are typically noncondensable at the operating temperatures of a recuperative heat exchanger, they are absorbed by water vapor condensate thereby forming acids. For example, carbon dioxide forms carbonic acid, nitrogen dioxide forms nitric acid, hydrogen chloride forms hydrochloric acid, and hydrogen fluoride forms hydrofluoric acid. In addition, sulfur dioxide will condense within a recuperative heat exchanger thereby forming sulfurous acid. The acidity of the condensate is further increased when water condensate evaporates leaving behind concentrated acids which corrosively attack the heat exchanger.

Corrosive attack may also occur on heat exchange surface areas which are only exposed to combustion products that are above their dew point temperature. At the beginning of the heating cycle, incipient condensation may briefly form on initially cool surface areas. As these surfaces become heated during the heating cycle, the condensation evaporates and does not reoccur. Localized corrosion may therefore occur on these surfaces.

There have been a number of prior art attempts to prevent heat exchanger damage caused by corrosive attack. In one approach, stainless steel components have been used because they are less susceptible to corrosion. Such heat exchangers, however, are very expensive. In order to limit the cost, heat has been transferred from the combustion products in stages wherein only the final stage heat exchanger is recuperative and therefore stainless steel only needs to be used for a relatively small condensing heat exchanger during a final stage. However, such arrangement introduces the complexity of having multiple combustion product heat exchangers. Further, it has been found that chlorides are often present in the environment at levels which produce sufficient hydrochloric acid to corrode even stainless steel. A stainless steel molybdenum alloy may be resistant to hydrochloric acid, but such material is prohibitively expensive for residential heat exchangers. In another approach, the condensing heat exchanger is flushed with pure water to rinse away acids after each firing of the burner. Such arrangement, however, puts constraints on the type of heat exchanger that can be used, and also increases the complexity and cost of the system.

My U.S. Pat. No. 4,681,085 describes a recuperative or condensing furnace wherein the dew point of combustion products is elevated above their natural dew point before introducing them into a combustion product heat exchanger. Accordingly, the formation of condensate in the recuperative heat exchanger is greatly increased, and the condensate runs downwardly in counterflow to the combustion products thereby continuously flushing away and preventing high concentrations of acid. Because a significant amount of condensate flows downwardly, the inner surfaces of the combustion product flow path through the heat exchanger are kept continuously wet. Thus, transition regions between wet and dry surface areas are eliminated or greatly reduced; these transition regions were found to exhibit high corrosion. Further, there was less corrosive attack because the temperature of the combustion products was lowered in the process of elevating the dew point before entering the heat exchanger. Thus, the surface areas of the heat exchanger were not heated to so high a temperature.

The dew point was described as being raised by providing a liquid containing reservoir adjacent the input of the heat exchanger and using a radiant burner wherein approximately 50% of the generated heat is radiant heat which is directed toward the liquid to raise its temperature. Such technique, however, is rather expensive because radiant burners are relatively costly to fabricate, and other methods require additional apparatus. That is, alternatively, the dew point was described as being raised by using a water atomizer or by spraying particles of water into the flow of combustion products.

SUMMARY OF THE INVENTION

It is an object of the invention to provide a high efficiency furnace having a heat exchanger that is resistive to corrosive attack.

Another object of the invention is to provide a furnace having improved apparatus and method for raising the dew point of combustion products so that a condensing or recuperative heat exchanger operates in a substantially continuous wet mode of operation.

It is also an object to provide a high efficiency condensing furnace that resists corrosive attack and can be fabricated relatively inexpensively.

It is also an object to provide apparatus and method for raising the dew point of combustion products without using a radiant burner.

Another object is to provide apparatus and method for providing dew point elevated combustion products that have reduced acidic content.

Still another object is to provide a condensing furnace wherein a continuously wet condensing heat exchanger is naturally flushed with pure water at the completion of a burning cycle.

In accordance with the invention, these and other objects and advantages are provided by so-called "submerged combustion" which is used to raise the dew point of the combustion products before introducing them into a recuperative heat exchanger. More specifically, a recuperative furnace in accordance with the invention comprises means for providing combustion products, means for holding a liquid and for directing the combustion products into the liquid wherein the combustion products bubble up through the liquid thereby raising the dew point of the combustion products, and a heat exchanger comprising means for extracting sensible heat and heat of condensation from the dew point elevated combustion products, the heat exchanger having an upwardly directed flow path for the dew point elevated combustion products wherein condensate from the condensation flows downwardly counter to the flow of the dew point elevated combustion products into the holding means.

The invention can also be practiced by a furnace comprising a burner for providing combustion products, a recuperative heat exchanger having an inclined flow path for the combustion products, means coupled between the burner and the recuperative heat exchanger for raising the dew point of the combustion products wherein the dew point raising means comprises a reservoir for holding liquid and for receiving condensate dripping from the recuperative heat exchanger, the reservoir means comprising a partition having a lower region normally submerged in the liquid thereby separating the reservoir into first and second chambers between the burner and the recuperative heat exchanger, and means for providing a pressure differential from the first chamber to the second chamber wherein the combustion products provided in the first chamber by the burner flow from the first chamber through the liquid into the second chamber wherein the dew point of the combustion products is elevated. It may be preferable that the burner be a screen burner having a face plate with fuel-air issuing perforations, each having a diameter of 0.040" or less. The pressure differential may preferably be provided by a combustion blower coupled to the input of the burner, or alternately, by an induced draft blower at the output of the recuperative heat exchanger. Preferably, the recuperative heat exchanger is a fin and tube heat exchanger wherein domestic water is passed through the tubes and heat is transferred from the combustion products passing across the fins. The partition preferably comprises means for distributing the flow of combustion products substantially uniformly along the partition. For example, the distributing means may comprise a plurality of slots or serrations along the bottom edge of the partition or a plurality of apertures therethrough. Also, it may be preferable that the partition be configured and arranged such that a portion of the condensate dripping from the recuperative heat exchanger lands on the partition to cool it. Another feature of the invention may include a controller for activating the pressure differential providing means and the burner wherein the controller comprises means for continuing to activate the pressure differential providing means for a predetermined time period after the burner is deactivated.

With such arrangement, the dew point of the combustion products can be sufficiently raised so as to operate the heat exchanger in a substantially continuous wet mode while utilizing a relatively inexpensive burner such as, for example, a screen burner. That is, significant amounts of heat are transferred to the water in the reservoir thereby enabling the dew point to be raised without the use of relatively expensive components such as, for example, a radiant burner, a water atomizer, or apparatus for spraying particles of water into the flow of combustion products. Further, the corrosion rate of the heat exchanger may be slightly reduced because soluble acids will be directly absorbed in the water by bubbling the combustion products through the water before entry into the heat exchanger. Another advantage is that by continuing to operate the system after the burner is shut off so as to extract thermal mass form the system, the air passing through the heat exchanger is saturated because it first bubbles through the water that is still hot. Accordingly, condensation in the heat exchanger continues after burner shut down, and such condensation is with pure water that drains downwardly to flush the heat exchanger of acidic substances.

BRIEF DESCRIPTION OF THE DRAWINGS

The foregoing objects and advantages will be more fully understood by reading the description of the preferred embodiment with reference to the drawings wherein.

DESCRIPTION OF THE PREFERRED EMBODIMENTS

Figure 1:
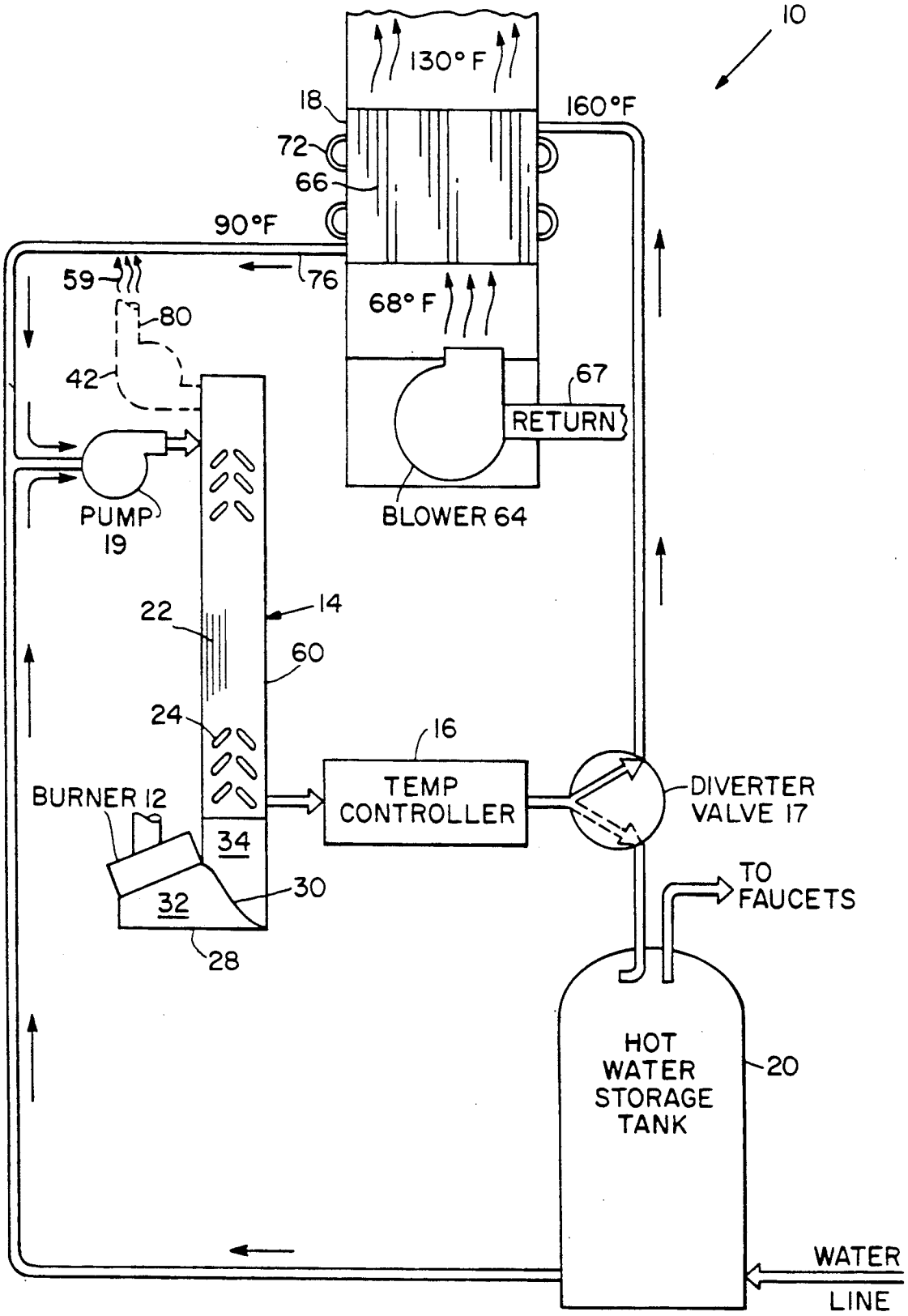
FIG. 1 is a diagrammatical view of a high efficiency furnace having a condensing heat exchanger.

Referring to FIG. 1, a space air and domestic hot water heating system 10 is shown to include a burner 12, a combustion products heat exchanger 14, a temperature controller 16, a diverter valve 17, a space air heat exchanger 18, a pump 19, and a hot water storage tank 20. As will be described in greater detail later herein, system 10 operates in alternate modes depending, among other factors, on the state of diverter valve 17. More specifically, when diverter valve 17 is in the position shown by the solid lines, hot water from combustion products heat exchanger 14 is directed through diverter valve 17 to space air heat exchanger 18 to heat return air which is then routed to heat the dwelling. The water thus cooled is then pumped by pump 19 to complete a loop back through combustion products heat exchanger 14. When diverter valve 17 is in the position shown by the dashed lines, hot water from combustion products heat exchanger 14 is either directed to a faucet or used to heat stratified hot water storage tank 20 while cold water is being drawn from the bottom of the tank 20 back through pump 19.

Figure 2:
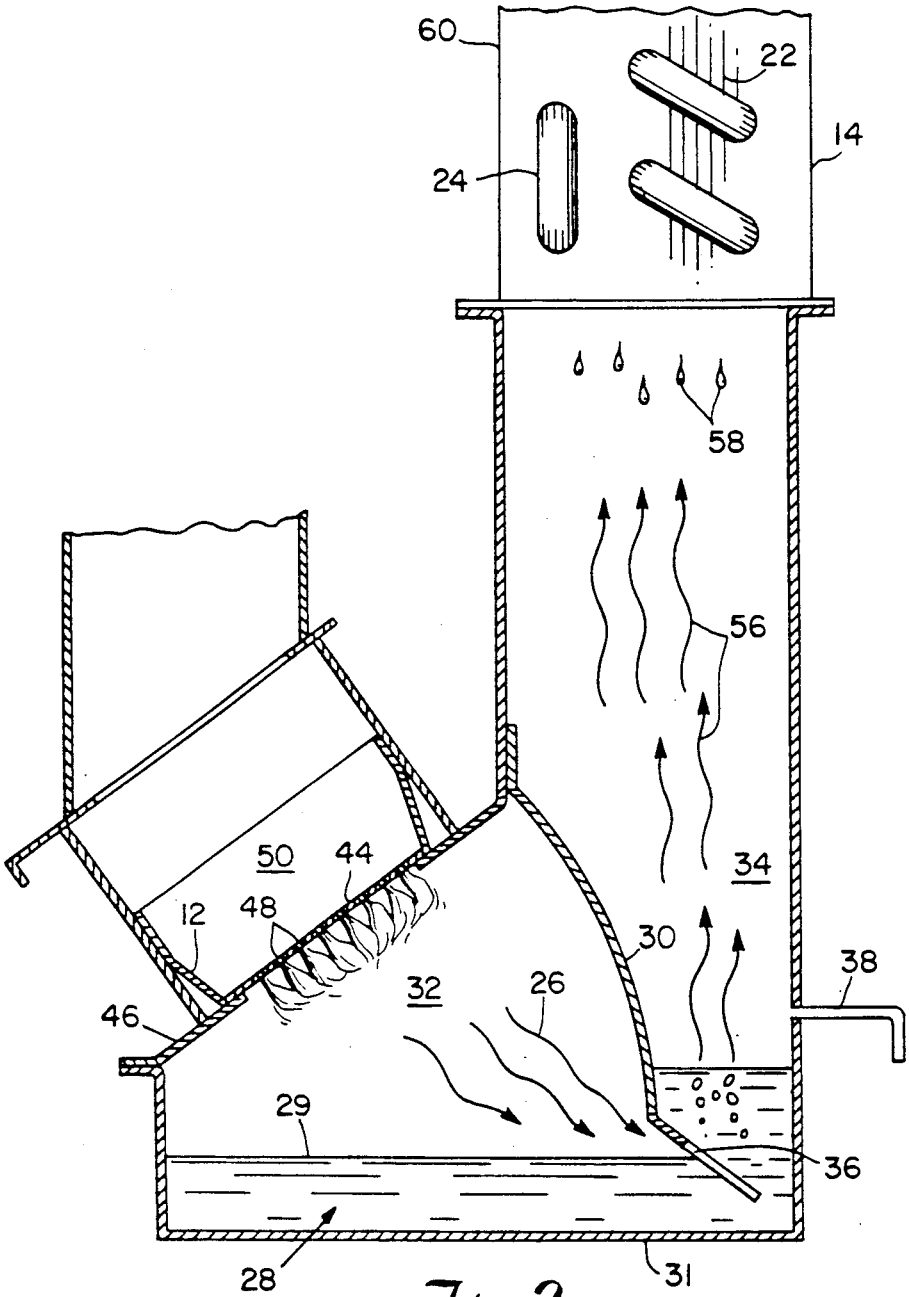
FIG. 2 is a side sectioned view of the burner and reservoir wherein the dew point of combustion products is raised by submerged combustion.

Referring to FIG. 2, combustion products heat exchanger 14 is a condensing or recuperative heat exchanger that operates in a continuous wet manner similar to that described in my U.S. Pat. No. 4,681,085 which is hereby incorporated by reference. More specifically, combustion products 26 from burner 12 are elevated in dew point before entering combustion product heat exchanger 14 so that condensing within combustion product heat exchanger 14 is greatly increased. As a result, condensate drains downwardly through the entire length of combustion product heat exchanger 14 in counter flow to the flow of combustion products, thereby keeping the flow path surfaces continuously wet. More specifically, combustion product heat exchanger 14 is a fin 22 and tube 24 heat exchanger with domestic water flowing through the tubes 24. Therefore, the fins 22 and the external surfaces of tubes 24 are maintained in a substantially continuous wet state. In addition to reducing the temperature to which the fins 22 are heated, the continuously wet operation eliminates or greatly reduces the transition regions between wet and dry areas within combustion products heat exchanger 14; these transition regions have been found to be very susceptible to corrosion.

Still referring to FIG. 2, the dew point of combustion products 26 from burner 12 is elevated by so-called submerged combustion. That is, combustion products 26 are forced or drawn down and bubbled through water 29 in reservoir 28. More specifically, reservoir 28 may typically include a tray 31 having a lateral length of approximately 20" with a partition 30 that separates reservoir 28 into a front chamber 32 and a back chamber 34. Near the bottom of partition 30 are a plurality of voids 36 that provide passageways from front chamber 32 to back chamber 34. In operation, water 29 which typically includes condensate is maintained in reservoir 28 such that voids 36 remain submerged. A positive pressure differential is provided between front chamber 32 and back chamber 34, thereby forcing or drawing the combustion products 26 from front chamber 32 through voids 36 from where they bubble up through the water 29 into back chamber 34. More specifically, the positive pressure differential causes the water level in front chamber 32 to lower and in back chamber 34 to rise thereby exposing voids 36 to provide passageways. In such manner, the combustion products 26 are significantly cooled, and the dew point is elevated or raised such as, for example, from approximately 128° F. to approximately 150°-160° F. Simply viewed, the elevated dew point combustion products store latent heat of vaporization that is recouped as heat of condensation in combustion products heat exchanger 14.

Figure 3A:
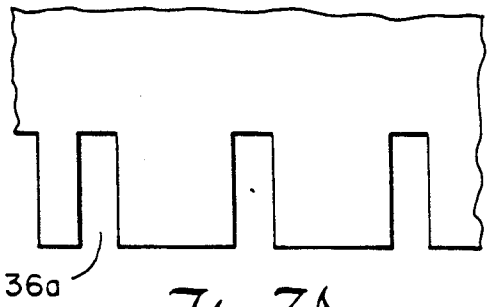
FIG. 3A is a front view of the partition in the reservoir.
Figure 3B:
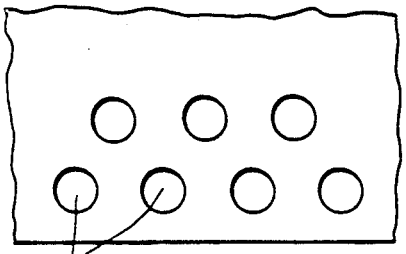
FIG. 3B is an alternate embodiment of FIG. 3A.

Referring to FIGS. 3A and 3B, alternate embodiments of voids 36 are shown. More specifically, FIG. 3A shows voids 36 to be a plurality of slots **36*a* such as ¼" slots that are equally spaced every ¾" along the 20" tray. FIG. 3B shows the voids 36 to be a plurality such as, for example, 32 ¼" circular apertures 36*b*. The voids 36, whether slots 36*a*, circular apertures 36*b*, or some other suitable opening along the lateral length of partition 30 provide a stabilizing pressure drop between front chamber 32 and back chamber 34. Stated differently, they provide substantially uniform distribution of the passage of combustion products 26 along the length of partition 30. They prevent a localized break through or hot spot that could occur if a substantial portion of the combustion products 26 were permitted to pass at a single location It is noted that the reservoir 28 should be substantially level to provide this function. There is optimum transfer of heat to water 29 and maximum raising of the dew point of combustion products 26 by using voids 36 to distribute the passage of combustion products 26 along the entire length of partition 30. The operating gap or exposed area of voids 36** may typically be approximately 1.5 $in^2$ for 80,000 Btu/hr. To increase the heating capacity, the pressure differential can be increased so as to increase the operating gap of the passageways.

Generally, a positive pressure differential between front chamber 32 and back chamber 34 can be made by either providing combustion blower 40 (FIG. 4) for burner 12, or alternatively providing blower 42 (FIG. 4) at the output of combustion products heat exchanger 14. In the former case, the burner 12 is commonly referred to as a power burner, and in the latter case, burner 12 is said to operate in an induced draft environment. One advantage of using combustion blower 40 is that it generally provides a very controlled homogeneous fuel-to-air mixture ratio whereas, with induced draft, care may have to be taken to adjust conventional fuel-to-air mixing apparatus. One disadvantage of a system 10 with combustion blower 40 is that great care has to be taken to seal all joints, and in particular within the combustion product heat exchanger 14 because otherwise combustion products could be forced out into the room; also, care must be taken to insure that combustion products do not bypass regions of the combustion product heat exchanger 14. On the other hand, these are not problem areas with induced draft apparatus wherein a negative pressure is induced in back chamber 34; the combustion products are drawn through the combustion product heat exchanger 14, and any leaks are retained within the system. Also, with induced draft, combustion products are drawn through all passageways within heat exchanger 14. In either case, when the combustion blower 40 or induced draft blower 42 is not operating, the level of water 29 in front chamber 32 and back chamber 34 would of course be the same. However, when the pressure differential is created, the pressure P1 in front chamber 32 is higher than the pressure P2 in back chamber 34 by at least approximately 1" of water, and maybe higher such as, for example, 3-4" of water. Drain 38 provides an exit for excess water 29.

As contrasted with the methods of raising the combustion product dew point as described in my U.S. Pat. No. 4,681,085, one advantage of raising the dew point by heretofore described submerged combustion is that a less expensive burner 12 can effectively be used. Here, burner 12 is a screen burner having a face plate 44 several inches high spanning the entire approximately 20" lateral width of burner box 46, and the face plate 44 has a large plurality of small holes 48 through which the gaseous fuel-air issues. Holes 48 may typically have a diameter of 0.025".

Assuming a 30% excess air/fuel mixture and input air having a 10% water vapor content as conventionally provided through a suitable mixing valve 49 (FIG. 4) or venturi, combustion products 26 are typically generated in the temperature range 2400°-2600° F. As is well known, one advantage of such a screen burner 12 is that the gas and air mix homogeneously within the cavity 50 before issuing through the holes 48 of the face plate 44, and therefore the air/fuel mixture burns clean without generating significant amounts of CO or hydrocarbons. The burning rate may depend on the particular household application, but screen burner 12 may typically provide 80,000 Btu/hr.-100,000 Btu/hr. As the combustion products 26 are bubbled through water 29 in reservoir 28, their temperature drops such as, for example, to 1100° F. or 1200° F., and the dew point is elevated from approximately 120° F. to the range from 150°-160° F.

Accordingly, the dew point elevated combustion products 56 are now suitably processed by submerged combustion for entry into combustion product heat exchanger 14.

Burner 12 could alternately be a tubular burner approximately 20" long with a single or series of stamped holes or ports along the bottom. The area of these holes would preferably be approximately 4 sq. in. such that a 100,000 Btu/hr. mixture of natural gas with about 50% primary air would adhere without flashback. In operation, the blue rich flame of the burner hole, and secondary air along the two dimensional sides are drawn down into the water 29 at a velocity of about 50 ft./sec. Such combustion products 26 may typically be at a temperature of approximately 2200° F. before entry into the water 29.

Although a significant advantage of submerged combustion is that a less expensive burner 12 other than a radiant burner can be used and still effectively raise the dew point of the combustion products 26 and heat the water 29, a radiant burner could also be used. Such a radiant burner typically has two screens wherein the outer screen glows red hot and radiates substantial energy to heat the water 29. Radiant burners are large and expensive, but they generally burn cleaner and operate at a temperature of approximately 1800° F. One advantage of this lower temperature is that nitrogen oxides (NO, $NO_2$, etc.) are not found in significant quantities unless the temperature is above 2000° F., there is excess oxygen, and there is sufficient resonance time. Although more nitrogen oxides may be formed with a screen burner or tubular burner operating at a higher temperature, the combustion products 26 are nevertheless rapidly quenched at the high flow rate into the water 29, so nitrogen oxide levels with such burners are still acceptable.

Another advantage of using a submerged combustion process to elevate the dew point is that the corrosion rate of combustion product heat exchanger 14 may be slightly reduced because more of the soluble acids will be absorbed directly by the bubble through process. Accordingly, the combustion products 56 entering the combustion products heat exchanger 14 may have less acid forming components. A further advantage is that the combustion product heat exchanger 14 may be flushed with pure water by continuing to operate the blower 40 or 42 after the supply of gas is shut off at the end of a cycle. More specifically, the blower 40 or 42 would typically be run for a short period such as, for example, 30 seconds after burner 12 shuts down so as to extract thermal mass from the system 10. During this period, pure air rather than combustion products is drawn through the water 29 which remains hot. Accordingly, the pure air is saturated as it bubbles through the hot water 29, and condensation continues in the combustion product heat exchanger 14. Thus, at the end of a burner cycle, the combustion product heat exchanger 14 is flushed by pure water that condenses therein.

Figure 4:
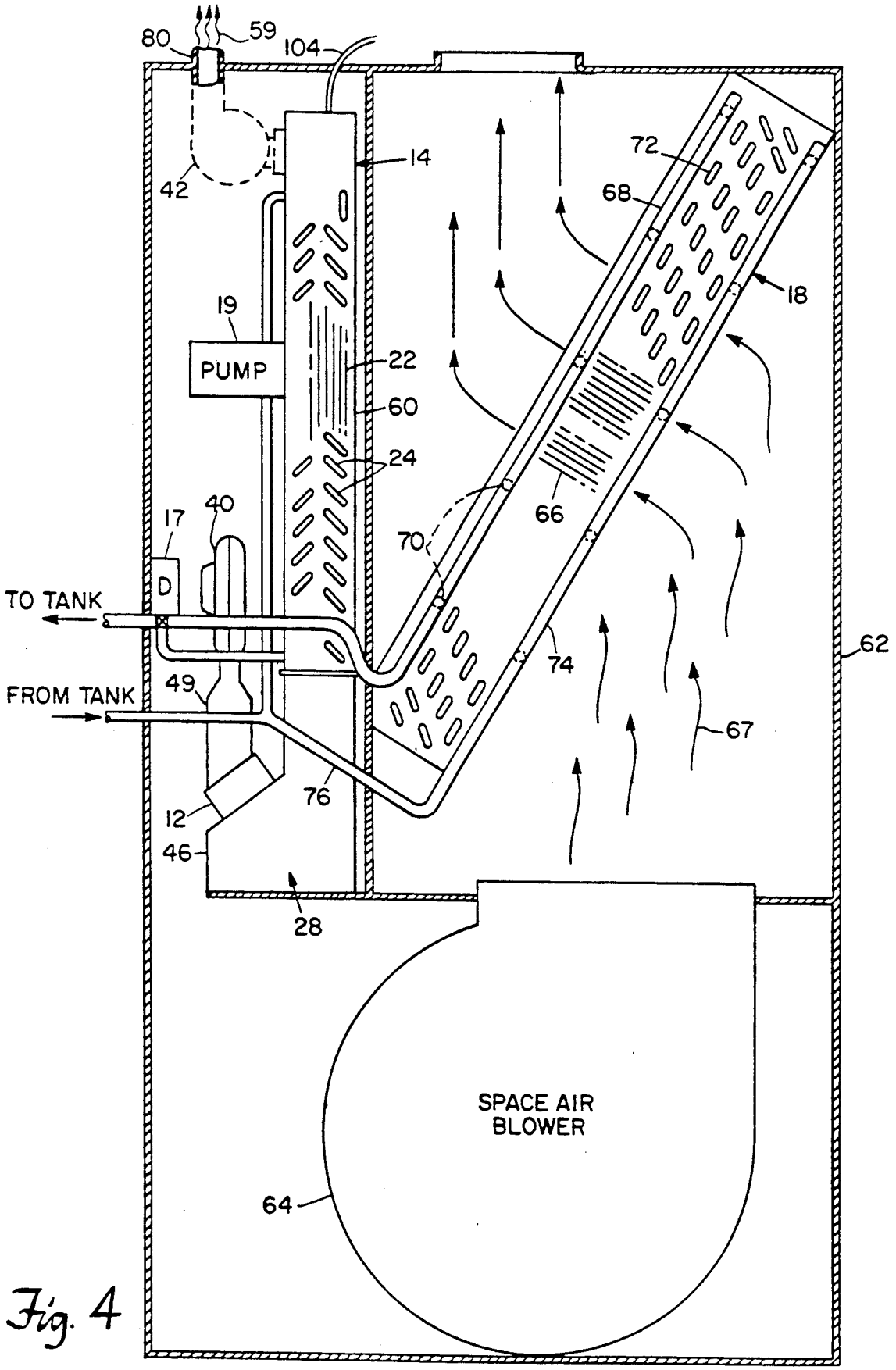
FIG. 4 is a side sectioned view of the high efficiency furnace.

Combustion product heat exchanger 14 is a fin 22 and tube 24 recuperative heat exchanger, and functions to transfer sensible heat and heat of condensation from dew point elevated combustion products 56 to domestic water that is forced through tubes 24. The combustion product heat exchanger 14 is upwardly elongated, and the combustion products 56 flow upwardly therethrough in counter flow to the domestic water that is introduced at the top of combustion product heat exchanger 14 as shown in FIGS. 1 and 4. The condensate 58 from the combustion products 56 flows downwardly in the opposite direction or counter to the flow of combustion products 56, and because the dew point of the combustion products 56 has been elevated in reservoir 28, there is sufficient condensation so as to keep the surfaces of fins 22 and the outer surfaces of tubes 24 substantially continuously wet. That is, transition regions between wet and dry surfaces that would normally be extremely susceptible to corrosion are eliminated or substantially reduced. The condensate 58 drains down into reservoir 28, and then is re-evaporated by the continuous submerged combustion bubbling process. Partition 30 is bowed outwardly in back chamber 34 as shown in FIG. 2 such that a portion of the dripping condensate 58 lands on and runs down partition 30. Such arrangement helps to limit the temperature of partition 30 which otherwise could warp or be damaged by the temperature in the burner box 46. In order to provide substantially wet surfaces for the entire height of combustion product heat exchanger 14, water in tubes 24 should be introduced into the top of combustion product heat exchanger 14 at a temperature substantially below the normal combustion product dew point such as, for example, 128° F., and preferably at a temperature below 100° F. such as, for example, 90° F. With such operation, the processed combustion products or flue gases 59 may exhaust at a relatively low temperature such as, for example, 105° F. having extracted enough heat so as to provide a system 10 with an efficiency in the mid 90% range.

As described heretofore, system 10 operates in either a space air heating mode or a domestic hot water heating mode. In the space air heating mode, it is preferable that water in tubes 24 exit the bottom of combustion product heat exchanger 14 at a relatively hot temperature such as, for example, 160° F. With such temperature, a relatively high $\Delta T$ can be provided with the space air thereby providing the desired heat transfer Q without using an unduly expensive space air heat exchanger 18 that has a large surface area A and/or unnecessarily high transfer coefficient H. Given the input water temperature of 90° F., an output temperature of 160° F., and the Btu rate to be delivered to the space air heat exchanger 18, the flow rate of water through combustion product heat exchanger 14 can readily be determined. For example, a typical flow rate may be 2.75 gallons/minute as provided by pump 19.

Combustion product heat exchanger 14 preferably satisfies a number of other conditions and parameters. First, water velocity in tubes 24 should be a minimum of 3 feet per second (fps) at outlets where the domestic water temperature is above 150° F. in order to avoid fouling or deposit generation. Second, the tube length and water velocity must be enough to yield effective counter flow heat exchange coefficients such that the tube-to-water temperature drop does not exceed about 10° F. Third, the water pressure drop which increases as the square of water velocity and linearly with the tube length should not exceed 7 pounds per square inch (psi). Fourth, fin corrosion should be such that combustion product heat exchanger 14 has a minimum life of 15 years. Finally, the water flow rate of 2.75 gallons/minute should have only small variations in order to insure counter flow effectiveness of both the combustion product heat exchanger 14 and space air heat exchanger 18. In accordance with the above described conditions and parameters, combustion product heat exchanger 14 may preferably have copper tubes 24 with an outer diameter of 0.375" and a wall thickness of 0.016". The tubes 24 may have three parallel counter flow channels of 20" length with 18 passes. The fin area of aluminum fins 22 may typically be 182 $ft^2$. The outer dimensions of combustion product heat exchanger 14 are here 18" high, 22" wide, with a thickness of 2⅝". The heat exchanger 14 is housed in a casing 60 that retains the combustion products 56.

Again referring to FIG. 1, temperature controller 16 senses the temperature of water in tubes 24 exiting combustion product heat exchanger 14, and adjusts that temperature to the set temperature by such conventional means as, for example, changing the rate of burner 12 or altering the water flow rate by controlling the pump 19 or adding restriction. Here, in the space air heating mode, approximately 160° F. hot water flows from combustion product heat exchanger 14 at a rate of 2.75 gallons/minute through temperature controller 16 and diverter valve 17 to the top of space air heat exchanger 18. As shown in FIG. 4, space air heat exchanger 18 is mounted at an incline rather than horizontal so as to limit the footprint size of cabinet 62. Here, a conventional space air blower 64 draws return air from the dwelling and forces it at approximately 1400 cubic feet per minute (cfm) through space air heat exchanger 18. Typically, the return air is at room temperature such as, for example, approximately 68° F., and is heated to approximately 125°-130° F. before being conveyed back to the rooms to be heated. The design parameters of the space air heat exchanger 18 are generally less stringent than the heretofore described design parameters of the combustion product heat exchanger 14. For example, the water velocity is relatively unimportant. Also, the pressure drop should not exceed 3 pounds per square inch (psi) on the water loop and the fins 66 and the fin design should be such that the 1400 cfm pressure drop is reasonable so as not to overload space air blower 64. It may be preferable to have an average counter-flow temperature differential of 25° F. or less. For example, the water comes into the top of space air heat exchanger 18 at approximately 160° F. and goes out the bottom at approximately 90° F. as described heretofore. The return air 67 may come in the bottom at approximately 70° F. and go out as heated space air 69 at 130° F. Therefore, there is an exchange temperature differential at the top of 30° F. (160° − 130° F.) and a temperature differential at the bottom of 20° F. (90° − 70° F.) for an average of 25° F. ((30° + 20° F.)/2). The hot water enters a manifold 68 at the top of heat exchanger 18 and, in a somewhat arbitrary design, heat exchanger 18 has six branches 70 each leading to eight cross-counter flow passes of ⅜" copper tubes 72. Heat exchanger 18 here has exterior space air flow surface dimensions of 12"×20" with a thickness of 7". In completing the space air heating loop, the water passes through outlet manifold 74 and tube 76 through pump 19 to the top of combustion product heat exchanger 14. As described heretofore, the temperature of water entering heat exchanger 14 is preferably 90° F., and, in any event, it is substantially below 128° F. so as to maintain the continuous wet operation within heat exchanger 14. Also, such operation limits the flue gas 59 temperatures such as, for example, to 105° F. so that relatively low temperature material may be being used for the flue pipe 80. In summary, heat exchangers 14 and 18 operate complimentary to each other in the space air heating mode with domestic water being recirculated between the two. Combustion products heat exchanger 14 transfers sensible heat and heat of condensation from the dew point elevated combustion products 56 to heat the recirculating water from 90° F. up to 160° F. The water in tubes 24 travels counter flow to the combustion products 56. That is, the combustion products 56 move upwardly while the water in tubes 24 moves downwardly. Heat exchanger 18 cools the water from 160° F. down to 90° F. by transferring heat to the return air 67. Heat exchanger 18 is also counter flow with the hot water travelling downwardly while the return air 67 moves upwardly.

For domestic water heating, diverter valve 17 is positioned in the dashed position as shown in FIG. 1, and pump 19 is activated so that the counter flow single pass heated water is fed into the top of hot water storage tank 20 while cooler water is being withdrawn from the bottom o storage tank 20 so that stratified layers of storage tank water move down with recharging. That is, the water at the top of hot water storage tank 20 will be at the temperature of water exiting heat exchanger 14, and the water at the bottom will be at a lower temperature. As relatively small amounts of domestic hot water are drawn, that drawn water comes from the top of the hot water storage tank by pressure from the water line. As water is drawn such that the temperature of hot water storage tank 20 drops to a predetermined temperature thereby initiating a call for more hot water, burner 12 and pump 19 are activated as will be described. If hot water continues to be drawn from a faucet, system 10 will supply that hot water and, if water is being heated at a faster rate than drawn, hot water storage tank 20 will simultaneously be recharged or heated. Typically, domestic hot water is provided at approximately 140° F., and its temperature should be adjustable according to individual preference. Further, the input temperature may vary depending on the season and operating conditions. For example, when water is brought in from the line during winter in northern climates, the water may have a temperature of, for example, 40° F. On the other hand, in the summer or when water is being withdrawn from storage tank 20 for recharging, the water may typically have a higher temperature such as, for example, 70° F. In any case, the water should be below 90° F. for the reasons described heretofore for maintaining continuous wet operation of heat exchanger 14. As described earlier, heat exchanger 14 provides a 70° F. temperature rise (90° − 160° F.) at a flow rate of 2.75 Gpm. Accordingly, assuming a set temperature of 140° F., temperature controller 16 senses the actual temperature and may increase or decrease the flow rate of pump 19 so as to provide the set temperature. For example, temperature controller 16 may decrease the flow rate from 2.75 to 2 gallons per minute to provide a water heating temperature differential of 100° F. (40° F. to 140° F.) in the winter.

Figure 5:
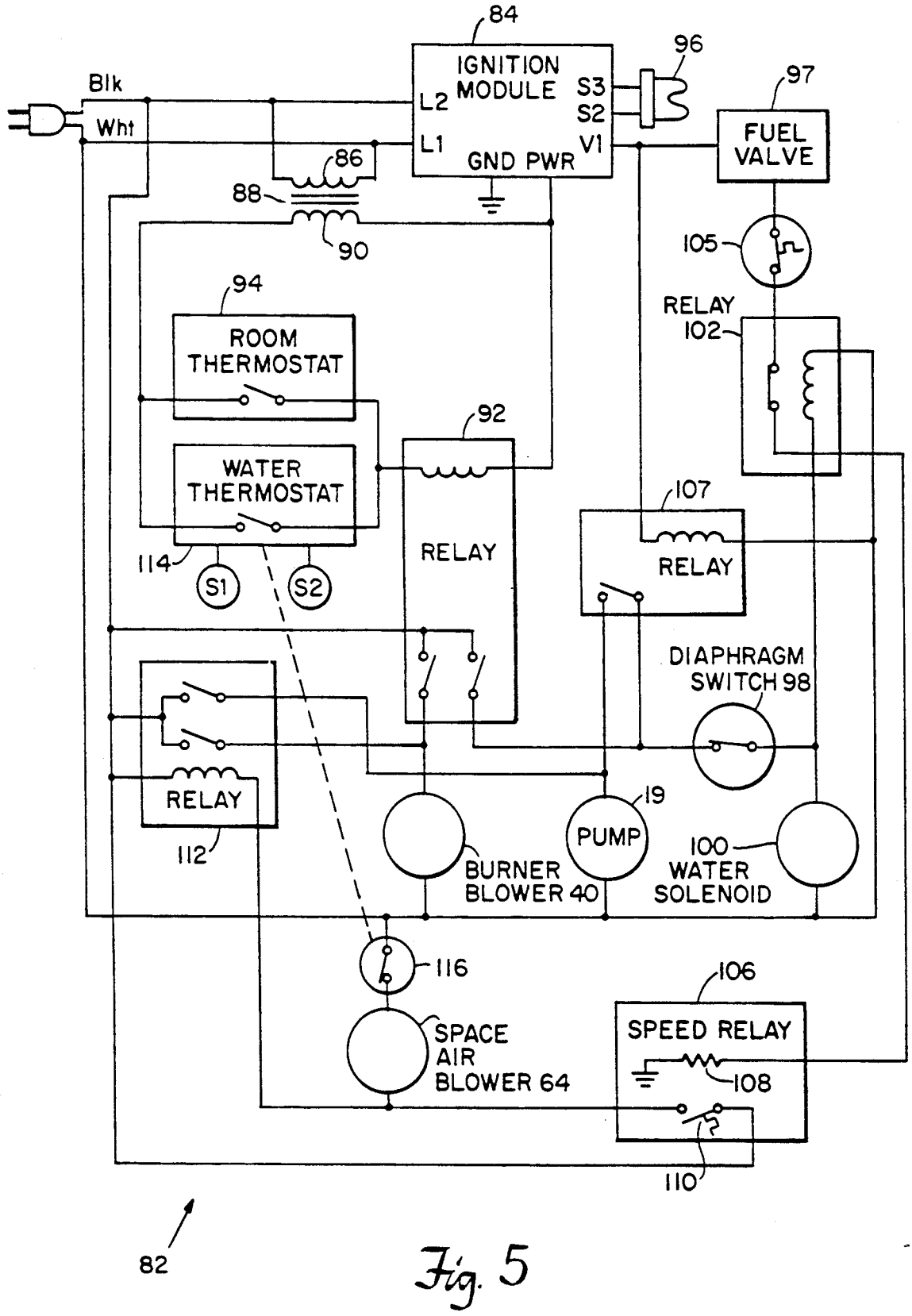
FIG. 5 is a diagram of a control system for the high efficiency furnace.

FIG. 5 shows a diagrammatical view of controller 82 for space air and domestic hot water heating system 10. 115 volt AC line voltage is connected to ignition module 84, and also to the primary winding 86 of transformer 88. The secondary winding 90 of transformer 88 is connected in a series loop with main relay 92 and room thermostat 94. The space air mode of operation of system 10 is initiated by the internal contacts of room thermostat 94 closing in response to the room falling below the set temperature. In response thereto, current is permitted to flow through and energize main relay 92. Also, the current flow through room thermostat 94 provides a control signal to PWR of ignition module 84 thereby initiating the ignition sequence. More specifically, ignition module 84 immediately energizes igniter 96 that is positioned adjacent burner 12. Accordingly, igniter 96 begins to heat up for subsequent ignition of burner 12 after ignition module 84 delays the opening of fuel valve 97 for some fixed time period such as, for example, 45 seconds. An example of an ignition module 84 is a solid state device which is commercially available from Fenwel, Inc., Division of Kidde, Inc. of Ashland, Mass., as Catalog Order No. 05-212225-107. Igniter 96 may, for example, be a commercially available Model No. 201A from Norton Company of Milford, N.H. Referring again to main relay 92 in FIG. 5, activation thereof by room thermostat 94 calling for heat energizes burner combustion blower 40 and water fill safety diaphragm switch 98 that is pneumatically coupled to front chamber 32 and back chamber 34. Diaphragm switch 98 is normally closed, and only opens when a preset pressure differential is provided between front chamber 32 and back chamber 34. Whether a burner blower 40 or an induced draft blower 42 is being used, the preset pressure differential is provided relatively quickly so long as there is sufficient water 29 in reservoir 28 to submerge partition 30 above voids 36. If there is not sufficient water 29 in reservoir 28 to achieve the pressure differential (eg. 1" of water) and enable submerged combustion as described heretofore, diaphragm switch 98 temporarily remains closed thereby energizing water solenoid 100 and also causing the normally closed contacts of relay 102 to open. Water solenoid 100 introduces water 29 into reservoir 28 such as by directing a stream of water into inlet 104 (FIG. 4) at the top of combustion products heat exchanger 14, such water running down through heat exchanger 14 into reservoir 28. Flow of current from diaphragm switch 98 through relay 102 opens the normally closed contacts thereby disabling activation of fuel valve 97 at least until the predetermined pressure differential is achieved between front chamber 32 and back chamber 34. If there is some anomaly such that the pressure differential is never reached, the fuel valve 97 is never enabled because such operation could damage to system 10, and, in particular, to heat exchanger 14. Typically, the diaphragm switch 98 opens relatively quickly indicating a sufficient level of water 29 in reservoir 28, and proper operation of blower 40 or 42. Such opening of diaphragm switch 98 in response to proper pressure differential disables water solenoid 100 and removes the disablement of fuel valve 97 by relay 102. Accordingly, assuming that diaphragm switch opens within 45 seconds of the call-for-heat which would normally be the case, fuel valve 97 is activated by ignition module 84 after the standard delay provided by ignition module 84. Thus, after the standard delay such as 45 seconds, current energizes fuel valve 97 by flowing through normally closed temperature sensitive click switch 105, the contacts of relay 102, and speed relay switch 106 to ground. Gaseous fuel is then introduced to burner 12 and is ignited by igniter 96 which is now hot.

At the same time that ignition module 84 energizes fuel valve 97, relay 107 is energized and AC line voltage is applied to pump 19 which initiates pumping of water in a loop through heat exchangers 14 and 18. Then, after some time delay such as, for example, 20-30 seconds, resistor 108 of speed relay switch 106 heats up to a temperature whereby normally open temperature sensitive switch 110 closes thereby energizing the 1400 cfm space air blower 64 and relay 112. Space air blower 64 is delayed after energization of fuel valve 97 so that there will be instant feed warm air from space air heat exchanger 18. The function of relay 112 is to provide line voltage to burner blower 40 or 42 and pump 19 independent of relay 92. Accordingly, during shut down when thermostat 94 opens thereby deenergizing relay 92, the operation of burner blower 40 or 42, pump 19, and space air blower 64 is continued until temperature sensitive switch 110 opens after resistor 108 cools down. During this additional running time, thermal mass of the system is removed. Also, as described earlier, pure air continues to be forced or drawn through the water 29 which remains hot. Accordingly, during the delay before temperature sensitive switch 110 opens, pure water is condensed on the aluminum fins 22 of combustion product heat exchanger 14. Thus, combustion product heat exchanger 14 is flushed with pure water to resist acidic corrosion therein. Temperature sensitive click switch 105 is positioned on flue pipe 80 so as to be responsive to the temperature of flue gases 59. More specifically, temperature sensitive click switch 105 such as used conventionally in domestic clothes dryers may be set to open when a temperature such as, for example, 120° F. is reached. This temperature may be approximately 20° above the normal operation, and is indicative that the combustion product heat exchanger 14 is over-heating. Such overheating may result for a variety of factors such as a failure of pump 19 or blower 64, or absence of water 29 in reservoir 28. In any event, temperature sensitive click switch 105 operates as a safety interlock to shut off fuel valve 97 when flue products 59 are excessively hot so as to prevent damage to the system 10, and more particularly, combustion product heat exchanger 14.

Still referring to FIG. 5, a call for domestic hot water by water thermostat 114 occurs when temperature sensor S1 which preferably is positioned approximately midlevel in stratified water storage tank 20 drops below its set point, say 120° F. Domestic hot water takes precedence over space heat so, in response thereto, water thermostat 114 causes diverter valve 17 to be in the dashed position as shown in FIG. 1, and also opens normally closed contacts 116 which disables space air blower 64. Thus, if system 10 is in the space air heating mode when a call for domestic hot water is received, the system 10 switches to domestic hot water mode deenergizing space air blower 64 and rerouting the hot water through the alternate passage of diverter valve 17. If a call for domestic hot water is received when system 10 is inactive, water thermostat 114 energizes main relay 92 and the ignition sequence starts up as described heretofore with reference to the space air mode. The hot water mode is terminated when temperature sensor S2 indicates that hot water storage tank is fully charged. For example, temperature sensor S2 is preferably located near the bottom of tank 20 and terminates the hot water mode when it reaches a temperature such as, for example, 110° F.

As described earlier, it is desirable that domestic hot water be provided at a constant temperature such as, for example, at 140° F. regardless of the water line temperature. Thus, while system 10 operates under substantially identical conditions in the space air heating mode (i.e. 90° F. water in and 160° F. out of heat exchanger 14), water thermostat 114 here activates temperature controller 16 in the hot water mode so that the speed of pump 19, for example, is adjusted to provide output water having a temperature of 140° F. Note that system 10 may switch from the space air heating mode to the domestic hot water heating mode and back again without interrupting the firing of burner 12.

This completes the description of the preferred embodiment of the invention. A reading of it by those skilled in the art will, however, bring to mind many alterations and modifications that do not depart from the spirit and scope of the invention. Accordingly, it is intended that the scope of the invention be limited only by the appended claims.

What is claimed is:

1. A furnace comprising:

a burner for providing combustion products;

a recuperative heat exchanger having an upward flow path for combustion products across metal heat exchange surfaces;

means coupled between said burner and said recuperative heat exchanger for raising the dew point of said combustion products from said burner before introduction into said recuperative heat exchanger;

said dew point raising means comprising reservoir means for holding liquid, said reservoir means comprising a partition having a lower region submerged in said liquid thereby separating said reservoir into first and second chambers between said burner and said recuperative heat exchanger;

means for providing a pressure differential from said first chamber to said second chamber wherein said combustion products provided in said first chamber by said burner flow from said first chamber through said liquid into said second chamber wherein the dew point of said combustion products is elevated;

means for cooling said combustion products in said recuperative heat exchanger below the natural dew point of said combustion products so that condensate forms on said metal heat exchange surfaces and flows downwardly counter to the upwardly flow of said combustion products maintaining said metal heat exchange surfaces in a substantially continuous set state, said second chamber of said reservoir means being positioned to receive condensate dripping from said recuperative heat exchanger; and a controller for activating said pressure differential providing means and said burner, said controller comprising means for continuing to activate said pressure differential providing means for a predetermined time period after said burner is deactivated.

2. The furnace recited in claim 1 wherein said burner is a screen burner.

3. The furnace recited in claim 2 wherein said screen burner has a face plate with fuel-air issuing perforations each having a diameter of 0.040 inches or less.

4. The furnace recited in claim 1 wherein said burner is a ported tubular burner.

5. The furnace recited in claim 1 wherein said pressure differential providing means comprises a combustion blower coupled to the input of said burner

6. The furnace recited in claim 1 wherein said pressure differential providing means comprises an induced draft blower coupled to the output of said recuperative heat exchanger.

7. The furnace recited in claim 1 wherein said heat exchange surfaces of said recuperative heat exchanger are fins of a fin and tube heat exchanger, said cooling means comprising means for forcing domestic water through said tubes and heat is transferred to said water from said dew point elevated combustion products passing across said fins.

8. The furnace recited in claim 1 wherein said partition comprises a submerged passageway from said first chamber to said second chamber.

9. The furnace recited in claim 8 wherein said passageway comprises a plurality of slots along the bottom edge of said partition.

10. The furnace recited in claim 8 wherein said passageway comprises a plurality of apertures in said partition.

11. The furnace recited in claim 1 wherein said partition comprises means for distributing the flow of said combustion products substantially uniformly along the length of said partition.

12. The furnace recited in claim 1 wherein said partition is positioned so that a portion of said condensate from said recuperative heat exchanger drips on said partition.

13. A recuperative furnace comprising:

means for providing combustion products;

means for holding a liquid and for directing said combustion products into said liquid wherein said combustion products bubble up through said liquid thereby raising the dew point of said combustion products;

a metal fin and tube heat exchanger comprising means for extracting sensible heat and heat of condensation from said dew point elevated combustion products, said heat exchanger having an upwardly directed flow path for said dew point elevated combustion products wherein condensate from said condensation flows downwardly counter to the flow of said dew point elevated combustion products in said heat exchanger and into said holding means, said extracting means comprising water passing through said tube and being heated by said combustion products passing over fins of said heat exchanger; and a controller for activating said combustion products providing means and said combustion products directing means, said controller comprising means for continuing to activate said combustion products directing means for a predetermined time period after said combustion products providing means is deactivated.

14. The furnace recited in claim 13 wherein said combustion products providing means comprises a screen burner.

15. The furnace recited in claim 14 wherein said screen burner has fuel issuing perforations, each having a diameter of 0.040 inches or less.

16. The furnace recited in claim 15 wherein said perforations have a diameter of approximately 0.025 inches.

17. The furnace recited in claim 13 wherein said holding and directing means comprises a reservoir having a partition with a lower region submerged in said liquid wherein said reservoir is separated into first and second chambers between said combustion products providing means and said heat exchanger, said holding and directing means further comprising means for providing a pressure differential between said first and second chambers.

18. The furnace recited in claim 17 wherein said pressure differential providing means comprises a combustion blower coupled to said combustion products providing means.

19. The furnace recited in claim 17 wherein said pressure differential providing means comprises an induced draft blower coupled to said heat exchanger.

20. The furnace recited in claim 17 wherein said partition comprises means for distributing the flow of said combustion products substantially uniformly along said partition.

21. The furnace recited in claim 20 wherein said distributing means comprises a plurality of slots along the bottom edge of said partition.

22. The furnace recited in claim 20 wherein said distributing means comprises a plurality of apertures in said partition.

23. A recuperative furnace comprising:

a burner for providing combustion products;

a fuel valve for providing a gaseous fuel to said burner;

a metal fin and tube recuperative heat exchanger having an upward flow path for combustion products across metal fins of said heat exchanger;

means for circulating water through the tube of said recuperative heat exchanger to extract sensible heat and heat of condensation from combustion products;

means for raising the dew point of combustion products from said burner before introduction into said heat exchanger, said dew point raising means comprising a reservoir for holding a liquid and for receiving condensate dripping from said heat exchanger;

said dew point raising means further comprising a partition having a lower portion submerged in said liquid wherein said reservoir is divided into first and second chambers;

said dew point raising means further comprising means for providing a positive pressure differential between said first and second chambers wherein said combustion products from said burner pass under said partition and bubble up through said liquid in said second chamber; and a controller for activating said fuel valve and said pressure differential providing means, said controller comprising means for continuing to activate said pressure differential providing means for a predetermined time period after said fuel valve is deactivated wherein air is directed through said liquid and into said heat exchanger during said predetermined time period.

24. A method of heating water passing through tubes of a metal fin and tube heat exchanger, comprising the steps of:

burning a gaseous fuel to provide combustion products;

providing a reservoir holding a liquid providing a partition having a lower portion submerged in said liquid to separate said reservoir into first and second chambers;

introducing said combustion products into said first chamber;

providing a pressure differential between said first and second chambers thereby lowering the level of said liquid in said first chamber so that said combustion products flow underneath a portion of said partition and bubble up through said liquid in said second chamber to raise the dew point of said combustion products;

directing said dew point elevated combustion products upwardly across the fins of said fin and tube heat exchanger to transfer sensible heat and heat of condensation from said dew point elevated combustion products to said water in a tube of said heat exchanger so that condensate flows downwardly in counter flow to said dew point elevated combustion products and maintains said fins in a substantially continuous wet state, said condensate dripping from said heat exchanger into said reservoir; and continuing to provide said pressure differential subsequent to terminating burning of gaseous fuel.

25. The method recited in claim 24 further comprising the step of distributing the flow of said combustion products underneath said partition substantially uniformly along said partition.

* * * * *